US010388235B2

(12) United States Patent
Guan

(10) Patent No.: US 10,388,235 B2
(45) Date of Patent: Aug. 20, 2019

(54) DISPLAY DRIVING METHOD AND DEVICE

(71) Applicant: SHENZHEN CHINA STAR OPTOELECTRONICS TECHNOLOGY CO., LTD., Shenzhen, Guangdong (CN)

(72) Inventor: Xiaoliang Guan, Guangdong (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/749,040

(22) PCT Filed: Jan. 12, 2018

(86) PCT No.: PCT/CN2018/072511
§ 371 (c)(1),
(2) Date: Jan. 30, 2018

(65) Prior Publication Data

US 2019/0206340 A1 Jul. 4, 2019

(30) Foreign Application Priority Data

Dec. 29, 2017 (CN) ..... 2017 1 1488537

(51) Int. Cl.
*G09G 3/36* (2006.01)
*G09G 3/20* (2006.01)

(52) U.S. Cl.
CPC ..... *G09G 3/3607* (2013.01); *G09G 3/2003* (2013.01); *G09G 2310/0264* (2013.01)

(58) Field of Classification Search
CPC ..... G09G 3/3607; G09G 3/2003; G09G 2310/0264
See application file for complete search history.

(56) References Cited

U.S. PATENT DOCUMENTS 8,050,496 B2 11/2011 Pan et al.
2005/0195298 A1* 9/2005 Byun ..... G06T 5/008 348/254
2007/0092153 A1* 4/2007 Kagaya ..... H04N 1/622 382/254
2007/0206858 A1* 9/2007 Recht ..... G06K 9/00127 382/181
2010/0020341 A1* 1/2010 Enjuji ..... G06T 5/008 358/1.9
2010/0194773 A1* 8/2010 Pan ..... G09G 5/02 345/590
2015/0049123 A1* 2/2015 Choi ..... G09G 3/2003 345/690
2017/0124709 A1* 5/2017 Rithe ..... G06K 9/2036

FOREIGN PATENT DOCUMENTS

CN 104658502 A 5/2015
CN 104680995 A 6/2015

* cited by examiner

*Primary Examiner* — Premal R Patel
(74) *Attorney, Agent, or Firm* — Hauptman Ham, LLP

(57) ABSTRACT

A display driving method and device is provided. The display driving method determines whether each image pixel is within a range of skin color in accordance with the original grayscale data of the image pixel, and performs color casting compensation only on the image pixels within the range of skin color but not on other image pixels. The effects of color casting compensation and display are improved, and the granular feeling caused due to the color casting compensation is reduced.

6 Claims, 2 Drawing Sheets

DISPLAY DRIVING METHOD AND DEVICE

RELATED APPLICATIONS

The present application is a National Phase of International Application Number PCT/CN2018/072511, filed on Jan. 12, 2018, and claims the priority of China Application 201711488537.7, filed on Dec. 29, 2017.

FIELD OF THE DISCLOSURE

The disclosure relates to a display technical field, and more particularly to a display driving method and device.

BACKGROUND

Liquid crystal display (LCD) has many advantages, such as thin body, power saving, no radiation, is widely used in various applications, such as LCD TVs, mobile phones, personal digital assistants (PDAs), digital cameras, computer screens or notebook screens, etc., and plays an important role in the field of flat panel display.

Most of the liquid crystal displays on the market are backlight-type liquid crystal displays, which include a liquid crystal display panel and a backlight module. The working principle of the liquid crystal display panel is to inject liquid crystal molecules between a thin film transistor array substrate (TFT Array Substrate) and a color filter (CF) substrate and apply driving voltages to two substrates to control the rotation direction of the liquid crystal molecules to refract the light from the backlight module to produce a picture.

Due to the optical anisotropy of liquid crystal molecules, there is a problem of color casting while looking the liquid crystal panel in a large viewing angle. In order to solve the problem of color casting in a large viewing angle of the liquid crystal panel, the existed method includes using a multi-domain pixel structure and pre-processing the input data signal voltage by using a color casting compensation algorithm, wherein the multi-domain pixel structure is to divide each sub-pixel in the image pixel into smaller display units, for example, a sub-pixel is divided into a main region and a sub region. The driving voltages of the main region and the sub region are proportional to each other so that the liquid crystal molecules corresponding to the main region and the sub region are deflected to different angles. Therefore, viewing results obtained from different angles could be better. Specific steps for implementing the color casting compensation algorithm include: generating a first display grayscale value and a second display grayscale value respectively according to the original grayscale values of each primary color component of each image pixel of the image to be displayed; using the first display grayscale value and the second display grayscale value to control the display brightness of two sub-pixels of the same color on the liquid crystal panel, respectively, wherein the first display grayscale value is greater than the second display grayscale value, so that the driving voltages applied to the two sub-pixels are different. Accordingly, the liquid crystal molecules of the two sub-pixels are deflected to different angles so that better viewing effects can be obtained by viewing the image at different angles, and the purpose of reducing color casting is achieved.

Wherein, an image is usually composed of a plurality of image pixels, and each image pixel includes three primary color components of red, green and blue. While driving to display an image, the brightness of a primary color component is controlled through providing a grayscale value needed for displaying to each primary color component of each image pixel so that the primary color component displays a corresponded color to display the image. In one image pixel, each primary color component controls two sub-pixels of the same color and adjacent to each other. That is, the red component correspondingly controls two adjacent red sub-pixels, the green component correspondingly controls two adjacent green sub-pixels, and the blue component correspondingly controls two adjacent blue sub-pixels, so that the first display grayscale value and the second display grayscale value generated from the original grayscale value of the red component respectively control the display brightness of the corresponded two red sub-pixels, the first display grayscale value and the second display grayscale value generated from the original grayscale value of the green component respectively control the display brightness of the corresponded two green sub-pixels, and the first display grayscale value and the second display grayscale value generated from the original grayscale value of the blue component respectively control the display brightness of the corresponded two blue sub-pixels. The display brightness of each image pixel is a mixture of the display brightness of the corresponded primary color components, and the display brightness of each primary color component is a mixture of the display brightness of the corresponded two sub-pixels. Generally, in order to keep the mixed display brightness of the two sub-pixels controlled by the first display grayscale value and the second display grayscale value being the same as the display brightness of the two sub-pixels controlled by the original grayscale value, the sum of the display brightness corresponding to the first display grayscale value and the display brightness corresponding to the second display grayscale value is usually set to be twice of the display brightness corresponding to the original grayscale value.

When the input data signal voltage is preprocessed by the color casting compensation algorithm in the existed technologies, the color casting compensation is performed on all the image pixels, the granular feeling is obvious, and the display effect is poor. In fact, when the user watches the displayed image in the side view, the most visible color casting occurs while display the skin color, and the user also pays more attention to the part of skin color of the displayed image.

SUMMARY

An object of the present invention is to provide a display driving method performing color casting compensation on only the pixel images in the range of skin color to improve the effects of color casting compensation and display, and reduce the granular feeling caused due to color casting compensation.

Another object of the present invention is to provide a display driving device performing color casting compensation on only the pixel images in the range of skin color to improve the effects of color casting compensation and display, and reduce the granular feeling caused due to color casting compensation.

In order to achieve at least one of the objects above, the present invention provides a display driving method, comprising:

step S1: receiving a display image and obtaining an original grayscale data of each of a plurality of image pixels in the display image;

step S2: determining whether each of the image pixels is within a range of skin color in accordance with the original grayscale data of each of the image pixels, wherein the range of skin color is set by a predetermined boundary function;

step S3: performing a color casting compensation on the original grayscale data of each of the image pixels within the range of skin color to generate a compensated grayscale data; and step S4: driving each of the image pixels within the range of skin color by using the compensated grayscale data, and driving each of the image pixels out of the range of skin color by using the original grayscale data.

In one embodiment, each of the image pixels comprises three primary color components of different colors being a first primary color component, a second primary color component and a third primary color component;

the original grayscale data of each of the image pixels comprises an original grayscale value of the first primary color component, an original grayscale value of the second primary color component, and an original grayscale value of the third primary color component.

In one embodiment, the step S3 comprises:

selecting at least one of the three primary color components of one of the image pixels within the range of skin color as a target component;

performing the color casting compensation on the original grayscale value of each of the target component of each of the image pixels within the range of skin color to generate a first display grayscale value and a second display grayscale value corresponding to the target component, wherein the first display grayscale value is greater than the second display grayscale value; and obtaining the compensated grayscale data by substituting the original grayscale value of each of the target component of each of the image pixels within the range of skin color with the first display grayscale value and the second display grayscale value of each of the target component.

In one embodiment, the predetermined boundary function comprises a first boundary function and a second boundary function, and a selected one of the image pixel is determined to be within the range of skin color when the original grayscale value of the first primary color component, the original grayscale value of the second primary color component and the original grayscale value of the third primary color component of the selected image pixel satisfy the first boundary function and the second boundary function simultaneously; otherwise the selected image pixel is determined to be out of the range of skin color;

the first boundary function is: $r+A1\times g+B1\times b+C1\geq 0$, and the second boundary function is: $r+A2\times g+B2\times b+C2\leq 0$;

wherein, r, g and b represent the original grayscale value of the first primary color component of the selected image pixel, the original grayscale value of the second primary color component of the selected image pixel and the original grayscale value of the third primary color component of the selected image pixel, respectively, and A1, A2, B1, B2, C1 and C2 are predetermined constants.

In one embodiment, the predetermined boundary function limits the range of skin color to be a closed three-dimensional space, and, when performing the color casting compensation on a first image pixel within the range of skin color and close to a boundary of the closed three-dimensional space and on a second image pixel within the range of skin color and far away from the boundary of the closed three-dimensional space, a difference between the first display grayscale value and the second display grayscale value of the target component of each color of the first image pixel is less than a difference between the first display grayscale value and the second display grayscale value of the target component of the each color of the second image pixel.

The present invention further provides a display driving device, comprising: a receiving unit, a determination unit connected with the receiving unit, a processing unit connected with the determination unit and a driving unit connected with the processing unit;

the receiving unit being used for receiving a display image and obtaining an original grayscale data of each of a plurality of image pixels in the display image;

the determination unit being used for determining whether each of the image pixels is within a range of skin color in accordance with the original grayscale data of each of the image pixels, wherein the range of skin color is set by a predetermined boundary function;

the processing unit being used for performing a color casting compensation on the original grayscale data of each of the image pixels within the range of skin color to generate a compensated grayscale data; and the driving unit being used for driving each of the image pixels within the range of skin color by using the compensated grayscale data, and driving each of the image pixels out of the range of skin color by using the original grayscale data.

In one embodiment, each of the image pixels comprises three primary color components of different colors being a first primary color component, a second primary color component and a third primary color component;

the original grayscale data of each of the image pixels comprises an original grayscale value of the first primary color component, an original grayscale value of the second primary color component, and an original grayscale value of the third primary color component.

In one embodiment, the processing unit is used for selecting at least one of the three primary color components of one of the image pixels within the range of skin color as a target component; performing the color casting compensation on the original grayscale value of each of the target component of each of the image pixels within the range of skin color to generate a first display grayscale value and a second display grayscale value corresponding to the target component, wherein the first display grayscale value is greater than the second display grayscale value; and obtaining the compensated grayscale data by substituting the original grayscale value of each of the target component of each of the image pixels within the range of skin color with the first display grayscale value and the second display grayscale value of each of the target component.

In one embodiment, the predetermined boundary function comprises a first boundary function and a second boundary function, and a selected one of the image pixel is determined to be within the range of skin color when the original grayscale value of the first primary color component, the original grayscale value of the second primary color component and the original grayscale value of the third primary color component of the selected image pixel satisfy the first boundary function and the second boundary function simultaneously; otherwise the selected image pixel is determined to be out of the range of skin color;

the first boundary function is: $r+A1\times g+B1\times b+C1\geq 0$, and the second boundary function is: $r+A2\times g+B2\times b+C2\leq 0$;

wherein, r, g and b represent the original grayscale value of the first primary color component of the selected image pixel, the original grayscale value of the second primary color component of the selected image pixel and the original grayscale value of the third primary color component of the selected image pixel, respectively, and A1, A2, B1, B2, C1 and C2 are predetermined constants.

In one embodiment, the predetermined boundary function limits the range of skin color to be a closed three-dimensional space, and, when the processing unit is further used for performing the color casting compensation on a first image pixel within the range of skin color and close to a boundary of the closed three-dimensional space and on a second image pixel within the range of skin color and far away from the boundary of the closed three-dimensional space, a difference between the first display grayscale value and the second display grayscale value of the target component of each color of the first image pixel is less than a difference between the first display grayscale value and the second display grayscale value of the target component of the each color of the second image pixel.

The present invention further provides a display driving method, comprising:

step S1: receiving a display image and obtaining an original grayscale data of each of a plurality of image pixels in the display image;

step S2: determining whether each of the image pixels is within a range of skin color in accordance with the original grayscale data of each of the image pixels, wherein the range of skin color is set by a predetermined boundary function;

step S3: performing a color casting compensation on the original grayscale data of each of the image pixels within the range of skin color to generate a compensated grayscale data; and step S4: driving each of the image pixels within the range of skin color by using the compensated grayscale data, and driving each of the image pixels out of the range of skin color by using the original grayscale data;

wherein each of the image pixels comprises three primary color components of different colors being a first primary color component, a second primary color component and a third primary color component;

the original grayscale data of each of the image pixels comprises an original grayscale value of the first primary color component, an original grayscale value of the second primary color component, and an original grayscale value of the third primary color component;

wherein the step S3 comprises:

selecting at least one of the three primary color components of one of the image pixels within the range of skin color as a target component;

performing the color casting compensation on the original grayscale value of each of the target component of each of the image pixels within the range of skin color to generate a first display grayscale value and a second display grayscale value corresponding to the target component, wherein the first display grayscale value is greater than the second display grayscale value; and obtaining the compensated grayscale data by substituting the original grayscale value of each of the target component of each of the image pixels within the range of skin color with the first display grayscale value and the second display grayscale value of each of the target component;

wherein the predetermined boundary function comprises a first boundary function and a second boundary function, and a selected one of the image pixel is determined to be within the range of skin color when the original grayscale value of the first primary color component, the original grayscale value of the second primary color component and the original grayscale value of the third primary color component of the selected image pixel satisfy the first boundary function and the second boundary function simultaneously; otherwise the selected image pixel is determined to be out of the range of skin color;

the first boundary function is: $r+A1\times g+B1\times b+C1\geq 0$, and the second boundary function is: $r+A2\times g+B2\times b+C2\leq 0$;

wherein, r, g and b represent the original grayscale value of the first primary color component of the selected image pixel, the original grayscale value of the second primary color component of the selected image pixel and the original grayscale value of the third primary color component of the selected image pixel, respectively, and A1, A2, B1, B2, C1 and C2 are predetermined constants;

wherein the predetermined boundary function limits the range of skin color to be a closed three-dimensional space, and, when performing the color casting compensation on a first image pixel within the range of skin color and close to a boundary of the closed three-dimensional space and on a second image pixel within the range of skin color and far away from the boundary of the closed three-dimensional space, a difference between the first display grayscale value and the second display grayscale value of the target component of each color of the first image pixel is less than a difference between the first display grayscale value and the second display grayscale value of the target component of the each color of the second image pixel.

The beneficial effects of the present invention are as follows: the present invention provides a display driving method which determines whether each image pixel is within a range of skin color in accordance with the original grayscale data of the image pixel, and performs color casting compensation only on the image pixels within the range of skin color but not on other image pixels so that the effects of color casting compensation and display are improved, and the granular feeling caused due to the color casting compensation is reduced. The present invention further provides a display driving device to improve the effects of color casting compensation and display, and reduce the granular feeling caused due to color casting compensation.

BRIEF DESCRIPTION OF THE DRAWINGS

Please refer to the detailed description and drawings below for better understanding of the features and technique contents of the present invention. However, the drawings are only examples used for explanations but not for limiting the present invention. In the drawings.

DETAILED DESCRIPTION OF PREFERRED EMBODIMENTS

The technique solutions and effects of the present invention is further described in detail with reference to accompanying drawings and preferred embodiments as follows.

Figure 1:
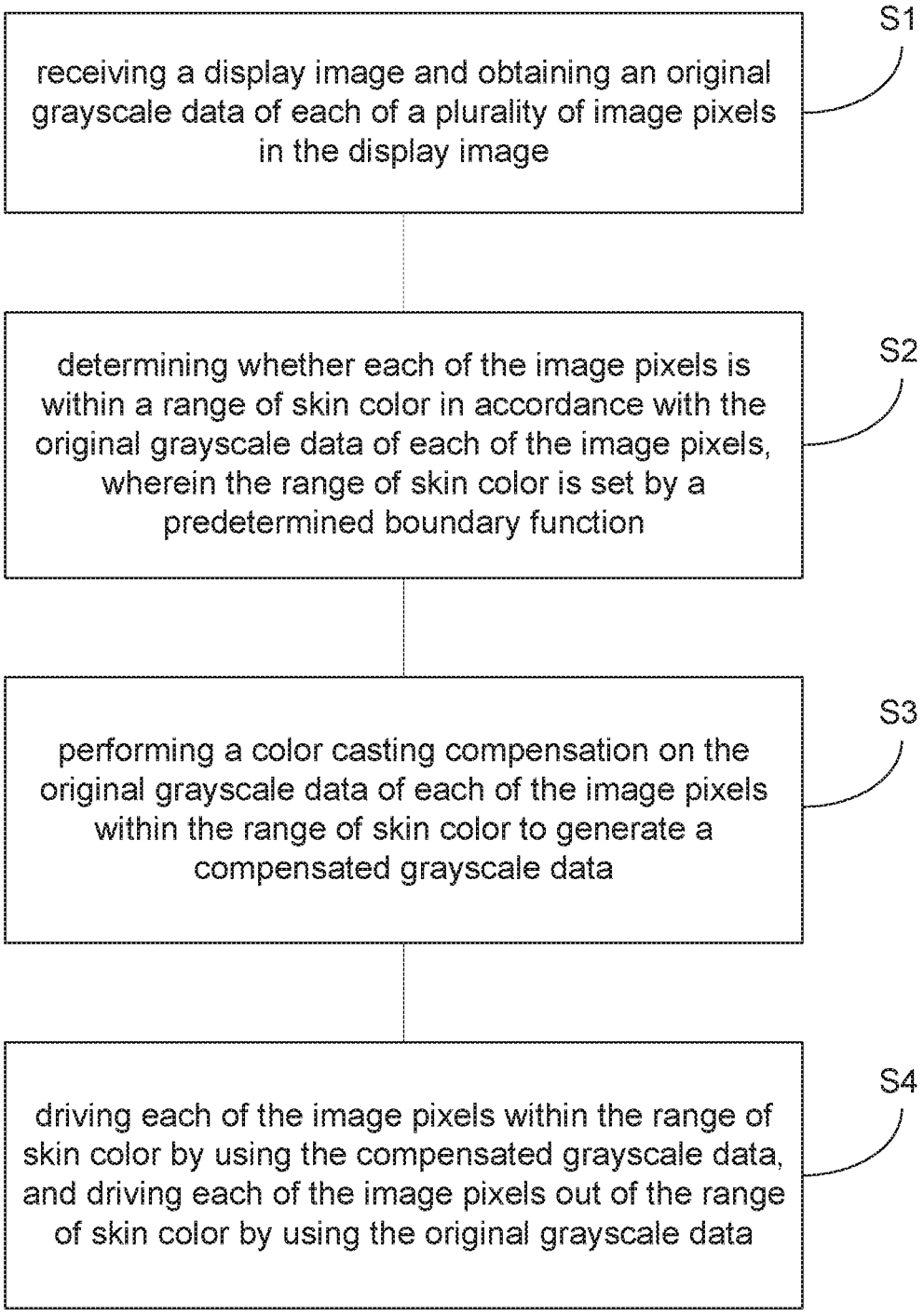
FIG. 1 is a flow chart of the display driving method according to one embodiment of the present invention.

Please refer to FIG. 1. The present invention provides a display driving method which could be applied to a vertical alignment (VA) liquid crystal display panel for compensating the insufficiency in viewing angles of the VA liquid crystal display panel and the difference in viewing angles between the VA liquid crystal display panel and the in-plane switching (IPS) liquid crystal display panel and reducing the granular feeling caused due to the color casting compensation, so that the VA liquid crystal display panel has wide viewing angle and pretty good display effect at the same time.

Wherein, the display driving method specifically comprising the steps as follows:

Step S1: receiving a display image and obtaining an original grayscale data of each of a plurality of image pixels in the display image.

Specifically, the display image is composed of a plurality of image pixels, and each image pixel comprises three primary color components with different colors being a first primary color component, a second primary color component and a third primary color component, respectively. An original grayscale data of the image pixel comprises: an original grayscale value of the first primary color component, an original grayscale value of the second primary color component and an original grayscale value of the third primary color component. The brightness of each primary color component is controlled through providing a grayscale value needed for displaying to each primary color component of each image pixel so that the primary color component displays a corresponded color to display the image. Preferably, the first primary color component, the second primary color component and the third primary color component are the red component, the green component and the blue component, respectively.

Furthermore, each primary color component of each image pixel controls adjacent two sub-pixels of the same color in the display panel to realize display. That is, an image pixel comprises six sub-pixels, and every two of the six sub-pixels correspond to one primary color component. For example, an image pixel comprises adjacent two red sub-pixels, adjacent two green sub-pixels and adjacent two blue sub-pixels, and the red component, the green component and the blue component are used to controlling the adjacent two red sub-pixels, the adjacent two green sub-pixels and the adjacent two blue sub-pixels to realize display.

Specifically, the original grayscale values of the first primary color component, the second primary color component and the third primary color component are all ranged from 0 to 255.

Step S2: determining whether each of the image pixels is within a range of skin color in accordance with the original grayscale data of each of the image pixels, wherein the range of skin color is set by a predetermined boundary function.

Specifically, the predetermined boundary function comprises a first boundary function and a second boundary function.

A specific procedure for determining whether each of the image pixels is within the range of skin color comprises: substituting the original grayscale values of the first, the second and the third primary color component of an image pixel into the first boundary function, and determining the image pixel to be out of the range of skin color when the original grayscale values of the first, the second and the third primary color component of the image pixel do not satisfy the first boundary function; substituting the original grayscale values of the first, the second and the third primary color component of the image pixel into the second boundary function when the original grayscale values of the first, the second and the third primary color component of the image pixel satisfy the first boundary function; and determining the image pixel to be within the range of skin color when the original grayscale values of the first, the second and the third primary color component of the image pixel satisfy the second boundary function, or, otherwise, determining the image pixel to be out of the range of skin color.

In other words, the image pixel is determined to be within the range of skin color when the original grayscale values of the first, the second and the third primary color component of the image pixel satisfy the first boundary function and the second boundary function at the same time. Otherwise, the image pixel is determined to be out of the range of skin color.

For example, in some embodiment of the present invention, the first boundary function is: $r+A1\times g+B1\times b+C1\geq 0$, and the second boundary function is: $r+A2\times g+B2\times b+C2\leq 0$;

wherein, r, g and b represent the original grayscale value of the first primary color component of the image pixel, the original grayscale value of the second primary color component of the image pixel and the original grayscale value of the third primary color component of the image pixel, respectively, r, g and b are ranged from 0 to 255, and A1, A2, B1, B2, C1 and C2 are predetermined constants. For example, in some embodiment of the present invention, values of A1, A2, B1, B2, C1 and C2 are −1, −4, 0, −2, 0 and 315, respectively, the first boundary function is $r-g\geq 0$ and the second boundary function is $r-4g-2b+315\leq 0$. At this time, whether the image pixel is within the range of skin color or not can be determined by substituting the original grayscale value r of the first primary color component of the image pixel, the original grayscale value g of the second primary color component of the image pixel and the original grayscale value b of the third primary color component of the image pixel into the first boundary function and the second boundary function.

Step S3: performing a color casting compensation on the original grayscale data of each of the image pixels within the range of skin color to generate a compensated grayscale data.

Specifically, the step S3 comprises: selecting at least one primary color components of the image pixels within the range of skin color as a target component while other primary color components being non-target components;

performing the color casting compensation on the original grayscale value of each target component of the image pixels within the range of skin color to generate a first display grayscale value and a second display grayscale value corresponding to the target component, wherein the first display grayscale value is greater than the second display grayscale value; and obtaining the compensated grayscale data by substituting the original grayscale value of each target component of the image pixels within the range of skin color with the first display grayscale value and the second display grayscale value of each target component.

In a preferred embodiment of the present invention, the step S3 selects the blue component of the image pixels within the range of the skin color as the target component, and the red component and the green component are non-target components. At this time, the step S3 performs the color casting compensation on the blue component of the image pixels within the range of skin color only, generates the first display grayscale value and the second display grayscale value corresponding to the blue component, and substitutes the original grayscale value of the blue component of the image pixels within the range of skin color with the first display grayscale value and the second display grayscale value of the blue component, so as to obtain the compensated grayscale data. The compensated grayscale data comprises: the first display grayscale value and the second display grayscale value of the blue component, the original grayscale value of the red component and the original grayscale value of the green component.

It is noted that, the predetermined boundary function in the present invention limits the range of skin color to be a closed three-dimensional space, and, in order to improve the display effect of skin color images, when the color casting compensation is performed on a first image pixel within the range of skin color and close to a boundary of the closed three-dimensional space and on a second image pixel within the range of skin color and far away from the boundary of the closed three-dimensional space, a difference between the first display grayscale value and the second display grayscale value of the target component of each color of the first image pixel is less than a difference between the first display grayscale value and the second display grayscale value of the target component of the same color of the second image pixel, so that the degree of color casting compensation of the image pixels is gradually increased from the boundary to center of the range of skin color. Correspondingly, in the preferred embodiment of the present invention described above, the difference between the first display grayscale value and the second display grayscale value of the blue component of the first image pixel is less than the difference between the first display grayscale value and the second display grayscale value of the blue component of the second image pixel.

It is worthy to note that, in other embodiments of the present invention, the primary color component of other colors, such as the red component or the green component, can be set as the target component; or, the primary color components of two colors, such as the red component and the green component, the red component and the blue component or the green component and the blue component, can both be set as the target components; or, the primary color components of the three colors, i.e., the red component, the green component and the blue component, are all set as the target components. When there is more than one primary color component to be set as the target component, the difference between the first display grayscale value and the second display grayscale value is adjusted for different primary color component in accordance with requirements, that is, the degree of color casting compensation on different primary color component could be modified independently.

Step S4: driving the image pixels within the range of skin color by using the compensated grayscale data, and driving the image pixels out of the range of skin color by using the original grayscale data.

Specifically, the process for driving the image pixels within the range of skin color by using the compensated grayscale data in the step S4 comprises:

driving every two sub-pixels corresponding to the target component by using the first display greyscale value and the second display grayscale value of the target component to display the first display greyscale value and the second display grayscale value of the target component; and driving every two sub-pixels corresponding to each non-target component by using the original greyscale value to display the original greyscale value of the corresponded non-target component.

In addition, the process for driving the image pixels out of the range of skin color by using the original grayscale data in the step S4 comprises: driving every two sub-pixels corresponding to each primary color component of each image pixel out of the range of skin color by using the original greyscale value of the primary color component.

As the example in the preferred embodiment described above, for the image pixels within the range of skin color, the two blue sub-pixels corresponding to the blue component are driven by using the first display greyscale value and the second display greyscale value of the blue component to display the first display greyscale value and the second display greyscale value of the blue component, respectively. The two red sub-pixels corresponding to the red component are driven by using the original greyscale value of the red component to display the original greyscale value of the red component, and the two green sub-pixels corresponding to the green component are driven by using the original greyscale value of the green component to display the original greyscale value of the green component.

For the image pixels out of the range of skin color, the two red sub-pixels corresponding to the red component are driven by using the original greyscale value of the red component to display the original greyscale value of the red component, the two green sub-pixels corresponding to the green component are driven by using the original greyscale value of the green component to display the original greyscale value of the green component, and the two blue sub-pixels corresponding to the blue component are driven by using the original greyscale value of the blue component to display the original greyscale value of the blue component.

Figure 2:
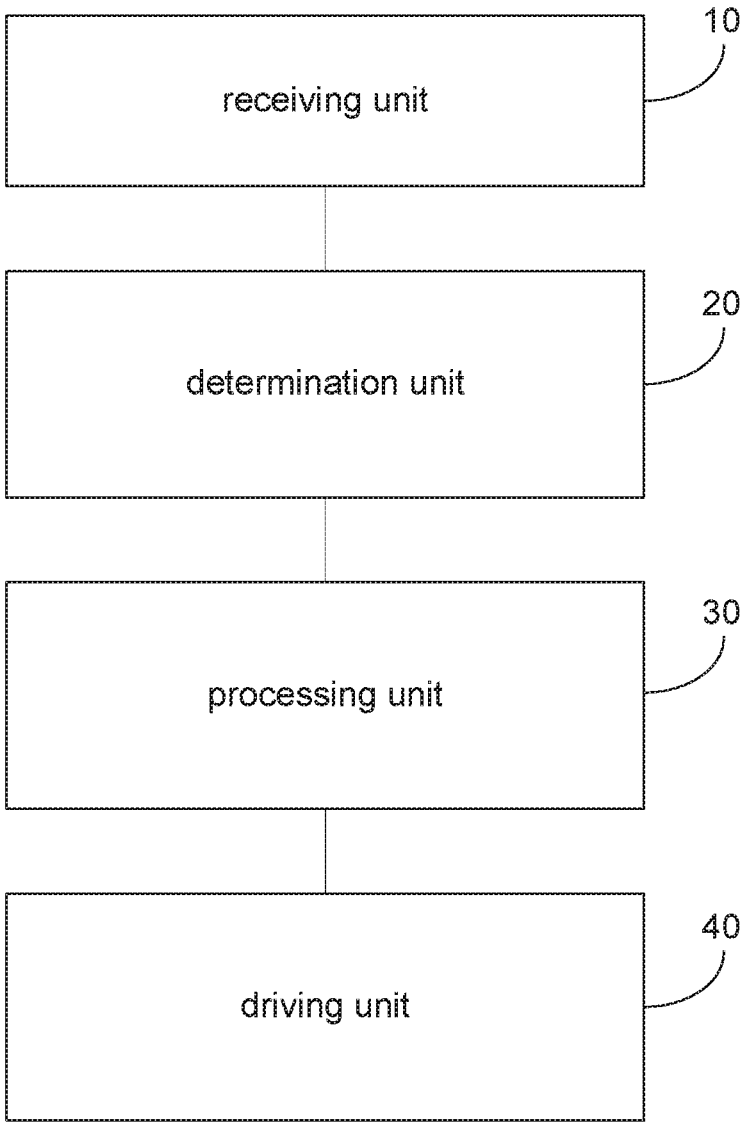
FIG. 2 is a schematic diagram of the display driving device according to one embodiment of the present invention.

Please refer to FIG. 2. The present invention further provides a display driving device which could be applied to a vertical alignment (VA) liquid crystal display panel for compensating the insufficiency in viewing angles of the VA liquid crystal display panel and the difference in viewing angles between the VA liquid crystal display panel and the in-plane switching (IPS) liquid crystal display panel and reducing the granular feeling caused due to the color casting compensation, so that the VA liquid crystal display panel has wide viewing angle and pretty good display effect at the same time.

The display driving device comprises a receiving unit 10, a determination unit 20 connected with the receiving unit 10, a processing unit 30 connected with the determination unit 20 and a driving unit 40 connected with the processing unit 30;

the receiving unit 10 being used for receiving a display image and obtaining an original grayscale data of each of a plurality of image pixels in the display image.

Specifically, the display image is composed of a plurality of image pixels, and each image pixel comprises three primary color components with different colors being a first primary color component, a second primary color component and a third primary color component, respectively. An original grayscale data of the image pixel comprises: an original grayscale value of the first primary color component, an original grayscale value of the second primary color component and an original grayscale value of the third primary color component. The brightness of each primary color component is controlled through providing a grayscale value needed for displaying to each primary color component of each image pixel so that the primary color component displays a corresponded color to display the image. Preferably, the first primary color component, the second primary color component and the third primary color component are the red component, the green component and the blue component, respectively.

Furthermore, each primary color component of each image pixel controls adjacent two sub-pixels of the same color in the display panel to realize display. That is, an image pixel comprises six sub-pixels, and every two of the six sub-pixels correspond to one primary color component. For example, an image pixel comprises adjacent two red sub-pixels, adjacent two green sub-pixels and adjacent two blue sub-pixels, and the red component, the green component and the blue component are used to controlling the adjacent two red sub-pixels, the adjacent two green sub-pixels and the adjacent two blue sub-pixels to realize display.

Specifically, the original grayscale values of the first primary color component, the second primary color component and the third primary color component are all ranged from 0 to 255.

The determination unit 20 is used for determining whether each of the image pixels is within a range of skin color in accordance with the original grayscale data of each of the image pixels, wherein the range of skin color is set by a predetermined boundary function.

Specifically, the predetermined boundary function comprises a first boundary function and a second boundary function.

A specific procedure performed by the determination unit 20 for determining whether each of the image pixels is within the range of skin color comprises: substituting the original grayscale values of the first, the second and the third primary color component of an image pixel into the first boundary function, and determining the image pixel to be out of the range of skin color when the original grayscale values of the first, the second and the third primary color component of the image pixel do not satisfy the first boundary function; substituting the original grayscale values of the first, the second and the third primary color component of the image pixel into the second boundary function when the original grayscale values of the first, the second and the third primary color component of the image pixel satisfy the first boundary function; and determining the image pixel to be within the range of skin color when the original grayscale values of the first, the second and the third primary color component of the image pixel satisfy the second boundary function, or, otherwise, determining the image pixel to be out of the range of skin color.

In other words, the image pixel is determined to be within the range of skin color when the original grayscale values of the first, the second and the third primary color component of the image pixel satisfy the first boundary function and the second boundary function at the same time. Otherwise, the image pixel is determined to be out of the range of skin color.

For example, in some embodiment of the present invention, the first boundary function is: $r+A1\times g+B1\times b+C1\geq 0$, and the second boundary function is: $r+A2\times g+B2\times b+C2\geq 0$;

wherein, r, g and b represent the original grayscale value of the first primary color component of the image pixel, the original grayscale value of the second primary color component of the image pixel and the original grayscale value of the third primary color component of the image pixel, respectively, r, g and b are ranged from 0 to 255, and A1, A2, B1, B2, C1 and C2 are predetermined constants. For example, in some embodiment of the present invention, values of A1, A2, B1, B2, C1 and C2 are −1, −4, 0, −2, 0 and 315, respectively, the first boundary function is $r-g\geq 0$ and the second boundary function is $r-4g-2b+315\leq 0$. At this time, whether the image pixel is within the range of skin color or not can be determined by substituting the original grayscale value r of the first primary color component of the image pixel, the original grayscale value g of the second primary color component of the image pixel and the original grayscale value b of the third primary color component of the image pixel into the first boundary function and the second boundary function.

The processing unit 30 is used for performing a color casting compensation on the original grayscale data of each of the image pixels within the range of skin color to generate a compensated grayscale data.

Specifically, the procedure performed by the processing unit 30 to generate the compensated greyscale data comprises: selecting at least one primary color components of the image pixels within the range of skin color as a target component while other primary color components being non-target components;

performing the color casting compensation on the original grayscale value of each target component of the image pixels within the range of skin color to generate a first display grayscale value and a second display grayscale value corresponding to the target component, wherein the first display grayscale value is greater than the second display grayscale value; and obtaining the compensated grayscale data by substituting the original grayscale value of each target component of the image pixels within the range of skin color with the first display grayscale value and the second display grayscale value of each target component.

In a preferred embodiment of the present invention, the processing unit 30 selects the blue component of the image pixels within the range of the skin color as the target component, and the red component and the green component are non-target components. At this time, the processing unit 30 performs the color casting compensation on the blue component of the image pixels within the range of skin color only, generates the first display grayscale value and the second display grayscale value corresponding to the blue component, and substitutes the original grayscale value of the blue component of the image pixels within the range of skin color with the first display grayscale value and the second display grayscale value of the blue component, so as to obtain the compensated grayscale data. The compensated grayscale data comprises: the first display grayscale value and the second display grayscale value of the blue component, the original grayscale value of the red component and the original grayscale value of the green component.

It is noted that, the predetermined boundary function in the present invention limits the range of skin color to be a closed three-dimensional space, and, in order to improve the display effect of skin color images, when the processing unit 30 performs the color casting compensation on a first image pixel within the range of skin color and close to a boundary of the closed three-dimensional space and on a second image pixel within the range of skin color and far away from the boundary of the closed three-dimensional space, a difference between the first display grayscale value and the second display grayscale value of the target component of each color of the first image pixel is controlled to be less than a difference between the first display grayscale value and the second display grayscale value of the target component of the same color of the second image pixel, so that the degree of color casting compensation of the image pixels is gradually increased from the boundary to center of the range of skin color. Correspondingly, in the preferred embodiment of the present invention described above, the difference between the first display grayscale value and the second display grayscale value of the blue component of the first image pixel is less than the difference between the first display grayscale value and the second display grayscale value of the blue component of the second image pixel.

It is worthy to note that, in other embodiments of the present invention, the primary color component of other colors, such as the red component or the green component, can be set as the target component; or, the primary color components of two colors, such as the red component and the green component, the red component and the blue component or the green component and the blue component, can both be set as the target components; or, the primary color components of the three colors, i.e., the red component, the green component and the blue component, are all set as the target components. When there is more than one primary color component to be set as the target component, the difference between the first display grayscale value and the second display grayscale value is adjusted for different primary color component in accordance with requirements. The difference between the first display grayscale value and the second display grayscale value of each target component could be the same as or different from others, that is, the degree of color casting compensation on each primary color component could be the same as or different from others.

The driving unit 40 is used for driving each of the image pixels within the range of skin color by using the compensated grayscale data, and driving each of the image pixels out of the range of skin color by using the original grayscale data.

Specifically, the procedure performed by the driving unit 40 for driving the image pixels within the range of skin color by using the compensated grayscale data comprises:

driving every two sub-pixels corresponding to the target component by using the first display greyscale value and the second display grayscale value of the target component to display the first display greyscale value and the second display grayscale value of the target component; and driving every two sub-pixels corresponding to each non-target component by using the original greyscale value to display the original greyscale value of the corresponded non-target component.

In addition, the process performed by the driving unit 40 for driving the image pixels out of the range of skin color by using the original grayscale data comprises: driving every two sub-pixels corresponding to each primary color component of each image pixel out of the range of skin color by using the original greyscale value of the primary color component.

As the example in the preferred embodiment described above, for the image pixels within the range of skin color, the two blue sub-pixels corresponding to the blue component are driven by using the first display greyscale value and the second display greyscale value of the blue component to display the first display greyscale value and the second display greyscale value of the blue component, respectively. The two red sub-pixels corresponding to the red component are driven by using the original greyscale value of the red component to display the original greyscale value of the red component, and the two green sub-pixels corresponding to the green component are driven by using the original greyscale value of the green component to display the original greyscale value of the green component.

For the image pixels out of the range of skin color, the two red sub-pixels corresponding to the red component are driven by using the original greyscale value of the red component to display the original greyscale value of the red component, the two green sub-pixels corresponding to the green component are driven by using the original greyscale value of the green component to display the original greyscale value of the green component, and the two blue sub-pixels corresponding to the blue component are driven by using the original greyscale value of the blue component to display the original greyscale value of the blue component.

In summary, the present invention provides a display driving method which determines whether each image pixel is within a range of skin color in accordance with the original grayscale data of the image pixel, and performs color casting compensation only on the image pixels within the range of skin color but not on other image pixels so that the effects of color casting compensation and display are improved, and the granular feeling caused due to the color casting compensation is reduced. The present invention further provides a display driving device to improve the effects of color casting compensation and display, and reduce the granular feeling caused due to color casting compensation.

The foregoing contents are detailed description of the disclosure in conjunction with specific preferred embodiments and concrete embodiments of the disclosure are not limited to the description. For the person skilled in the art of the disclosure, without departing from the concept of the disclosure, simple deductions or substitutions can be made and should be included in the protection scope of the application.

What is claimed is:

1. A display driving method, comprising:

step S1: receiving a display image and obtaining an original grayscale data of each of a plurality of image pixels in the display image;

step S2: determining whether each of the image pixels is within a range of skin color in accordance with the original grayscale data of each of the image pixels, wherein the range of skin color is set by a predetermined boundary function;

step S3: performing a color casting compensation on the original grayscale data of each of the image pixels within the range of skin color to generate a compensated grayscale data; and step S4: driving each of the image pixels within the range of skin color by using the compensated grayscale data, and driving each of the image pixels out of the range of skin color by using the original grayscale data.

2. The display driving method according to claim 1, wherein each of the image pixels comprises three primary color components of different colors being a first primary color component, a second primary color component and a third primary color component;

the original grayscale data of each of the image pixels comprises an original grayscale value of the first primary color component, an original grayscale value of the second primary color component, and an original grayscale value of the third primary color component.

3. The display driving method according to claim 2, wherein the step S3 comprises:

selecting at least one of the three primary color components of one of the image pixels within the range of skin color as a target component;

performing the color casting compensation on the original grayscale value of each of the target component of each of the image pixels within the range of skin color to generate a first display grayscale value and a second display grayscale value corresponding to the target component, wherein the first display grayscale value is greater than the second display grayscale value; and obtaining the compensated grayscale data by substituting the original grayscale value of each of the target component of each of the image pixels within the range of skin color with the first display grayscale value and the second display grayscale value of each of the target component.

4. The display driving method according to claim 3, wherein the predetermined boundary function limits the range of skin color to be a closed three-dimensional space, and, when performing the color casting compensation on a first image pixel within the range of skin color and close to a boundary of the closed three-dimensional space and on a second image pixel within the range of skin color and far away from the boundary of the closed three-dimensional space, a difference between the first display grayscale value and the second display grayscale value of the target component of each color of the first image pixel is less than a difference between the first display grayscale value and the second display grayscale value of the target component of the each color of the second image pixel.

5. The display driving method according to claim 2, wherein the predetermined boundary function comprises a first boundary function and a second boundary function, and a selected one of the image pixel is determined to be within the range of skin color when the original grayscale value of the first primary color component, the original grayscale value of the second primary color component and the original grayscale value of the third primary color component of the selected image pixel satisfy the first boundary function and the second boundary function simultaneously; otherwise the selected image pixel is determined to be out of the range of skin color;

the first boundary function is: $r+A1\times g+B1\times b+C1\geq 0$, and the second boundary function is: $r+A2\times g+B2\times b+C2\leq 0$;

wherein, r, g and b represent the original grayscale value of the first primary color component of the selected image pixel, the original grayscale value of the second primary color component of the selected image pixel and the original grayscale value of the third primary color component of the selected image pixel, respectively, and A1, A2, B1, B2, C1 and C2 are predetermined constants.

6. A display driving method, comprising:

step S1: receiving a display image and obtaining an original grayscale data of each of a plurality of image pixels in the display image;

step S2: determining whether each of the image pixels is within a range of skin color in accordance with the original grayscale data of each of the image pixels, wherein the range of skin color is set by a predetermined boundary function;

step S3: performing a color casting compensation on the original grayscale data of each of the image pixels within the range of skin color to generate a compensated grayscale data; and step S4: driving each of the image pixels within the range of skin color by using the compensated grayscale data, and driving each of the image pixels out of the range of skin color by using the original grayscale data;

wherein each of the image pixels comprises three primary color components of different colors being a first primary color component, a second primary color component and a third primary color component;

the original grayscale data of each of the image pixels comprises an original grayscale value of the first primary color component, an original grayscale value of the second primary color component, and an original grayscale value of the third primary color component;

wherein the step S3 comprises:

selecting at least one of the three primary color components of one of the image pixels within the range of skin color as a target component;

performing the color casting compensation on the original grayscale value of each of the target component of each of the image pixels within the range of skin color to generate a first display grayscale value and a second display grayscale value corresponding to the target component, wherein the first display grayscale value is greater than the second display grayscale value; and obtaining the compensated grayscale data by substituting the original grayscale value of each of the target component of each of the image pixels within the range of skin color with the first display grayscale value and the second display grayscale value of each of the target component;

wherein the predetermined boundary function comprises a first boundary function and a second boundary function, and a selected one of the image pixel is determined to be within the range of skin color when the original grayscale value of the first primary color component, the original grayscale value of the second primary color component and the original grayscale value of the third primary color component of the selected image pixel satisfy the first boundary function and the second boundary function simultaneously; otherwise the selected image pixel is determined to be out of the range of skin color;

the first boundary function is: $r+A1\times g+B1\times b+C1\geq 0$, and the second boundary function is: $r+A2\times g+B2\times b+C2\leq 0$;

wherein, r, g and b represent the original grayscale value of the first primary color component of the selected image pixel, the original grayscale value of the second primary color component of the selected image pixel and the original grayscale value of the third primary color component of the selected image pixel, respectively, and A1, A2, B1, B2, C1 and C2 are predetermined constants;

wherein the predetermined boundary function limits the range of skin color to be a closed three-dimensional space, and, when performing the color casting compensation on a first image pixel within the range of skin color and close to a boundary of the closed three-dimensional space and on a second image pixel within the range of skin color and far away from the boundary of the closed three-dimensional space, a difference between the first display grayscale value and the second display grayscale value of the target component of each color of the first image pixel is less than a difference between the first display grayscale value and the second display grayscale value of the target component of the each color of the second image pixel.

* * * * *